US006988288B2

(12) United States Patent
Wang

(10) Patent No.: US 6,988,288 B2
(45) Date of Patent: Jan. 24, 2006

(54) CHAIN LINK REMOVER FOR CYCLES

(76) Inventor: Lopin Wang, 16F-2, No. 17, Lane 52, Sec. 3, Rehe Road, Beitun Chu, Taichung (TW) 406

( * ) Notice: Subject to any disclaimer, the term of this patent is extended or adjusted under 35 U.S.C. 154(b) by 64 days.

(21) Appl. No.: 10/823,123

(22) Filed: Apr. 12, 2004

(65) Prior Publication Data

US 2005/0223497 A1 Oct. 13, 2005

(51) Int. Cl.
*B25B 13/00* (2006.01)

(52) U.S. Cl. ..... 7/138; 59/11; 81/440

(58) Field of Classification Search ..... 59/7, 59/11, 35.1; 7/138, 168; 81/440
See application file for complete search history.

(56) References Cited

U.S. PATENT DOCUMENTS

| | | | | |
|---|---|---|---|---|
| 4,103,378 | A * | 8/1978 | Granados | 7/138 |
| 4,967,435 | A | 11/1990 | Seals | 7/139 |
| 5,303,439 | A | 4/1994 | Seals | 7/138 |
| 2002/0073490 | A1 * | 6/2002 | Wu | 7/138 |

* cited by examiner

*Primary Examiner*—Debra S Meislin
(74) *Attorney, Agent, or Firm*—Charles E. Baxley

(57) ABSTRACT

A chain link remover includes a base having an opening formed by an anvil and having a screw hole for threading with a threaded shaft which has a link ejector rod to remove the chain link pin from the chain. A support device is disposed in the base to support the chain in the opening of the base, and to retain the chain between the anvil and the threaded shaft, and thus to allow the chain link pin to be easily disengaged or removed from the chain without holding by the users. The support device includes two pawls to engage with and to support the chain between the anvil and the threaded shaft, with such as resiliences.

16 Claims, 14 Drawing Sheets

CHAIN LINK REMOVER FOR CYCLES

BACKGROUND OF THE INVENTION

1. Field of the Invention

The present invention relates to a chain link remover, and more particularly to a chain link remover for cycles having a chain support structure to support the chain and to allow the chain link to be easily removed from the chain.

2. Description of the Prior Art

Typical chain link removers for cycles have been developed for removing chain links from chains, and comprise an anvil to anchor or position the chain, and a threaded shaft to engage with the chain link pins, and to remove the chain link pins from the chains.

For example, U.S. Pat. No. 4,967,435 to Seals, and U.S. Pat. No. 5,303,439 to Seals disclose two of the typical chain link removers for cycles, and also comprise an anvil to anchor or position the chain, and a threaded shaft to engage with the chain link pins, and to remove the chain link pins from the chains. For removing the chain link pins from the chains, the chains are required to be disposed or engaged into the typical chain link removers, and disposed between the anvil and the threaded shaft, and is required to align the chain link pins with the threaded shaft.

However, the typical chain link removers do not include any support device to stably support and position the chain between the anvil and the threaded shaft, such that the users have to use one of their hands to hold and position the chain between the anvil and the threaded shaft, and then to use the other hand to thread or to rotate the threaded shaft relative to the chain link removers, and such that the users may not easily operate the typical chain link removers.

The present invention has arisen to mitigate and/or obviate the afore-described disadvantages of the conventional chain link removers for cycles.

SUMMARY OF THE INVENTION

The primary objective of the present invention is to provide a chain link remover for cycles including a chain support structure to support the chain and to allow the chain link to be easily removed from the chain.

In accordance with one aspect of the invention, there is provided a chain link remover comprising a base including an opening formed therein and defined by an anvil, the anvil including a vertical slot formed therein to receive a chain link pin of a chain, the base including a screw hole formed therein and aligned with the vertical slot of the anvil, a threaded shaft threaded with the screw hole of the base, and including a link ejector rod for engaging with and for removing the chain link pin from the chain, and a support device provided in the opening of the base to support the chain in the opening of the base, and to retain the chain between the anvil and the threaded shaft, and thus to allow the chain link pin to be easily disengaged or removed from the chain without holding by the users.

The support device includes two pawls to engage with and to support the chain between the anvil and the threaded shaft. For example, the support device includes a carrier to support the pawls thereon.

The pawls may be pivotally attached to the carrier with pivot pins respectively. For example, the carrier includes two hubs, and each of the pawls includes a hub pivotally attached to the hubs of the carrier with the pivot pins respectively.

The base includes a passage formed therein to slidably receive the carrier. The base includes a depression formed therein, and the carrier includes a flap laterally extended therefrom and slidably engaged in the depression of the base, and to guide the carrier to slide relative to the base, and to limit the sliding movement of the carrier relative to the base. A spring may be engaged with the carrier, to bias the carrier against the anvil.

The carrier includes a bore formed therein to slidably receive a tube, and to slidably attach the carrier onto the tube, the spring may be engaged on the tube. A casing may be provided to receive the tube, and includes two protuberances each having a hole formed therein to receive the tube therein. The casing may include a cover attached to bottom thereof.

The casing includes two caps attached to the holes, to retain the tube in the casing. The casing includes a handle extended therefrom. The casing includes at least one tool member attached to the handle. A tool device may be detachably attached to the handle, and includes at least one magnet for magnetically attaching the tool device to the handle.

One or more spare chain link pins may further be provided and received in the tube. The carrier includes a seat provided thereon and disposed between the pawls.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
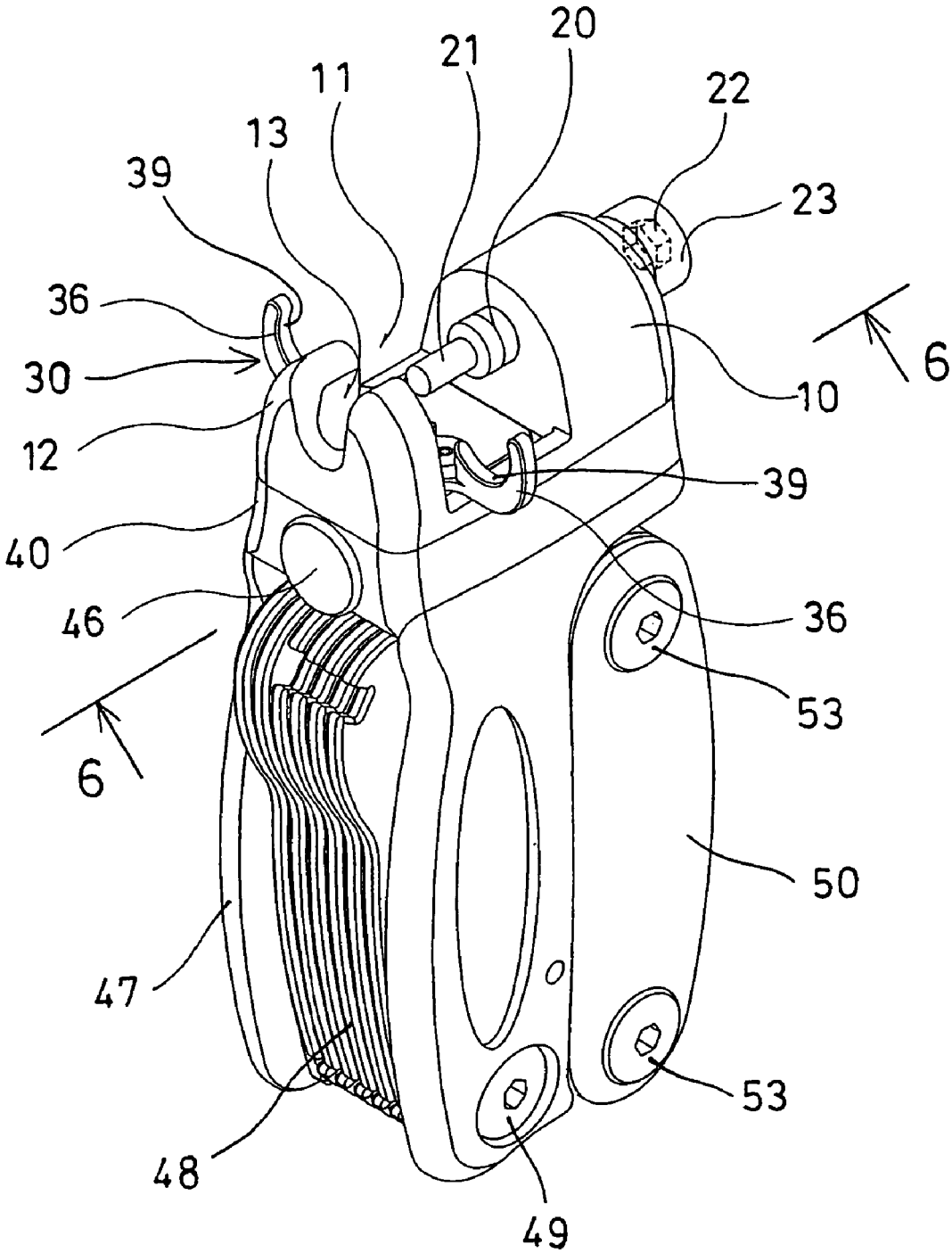
FIG. 1 is a perspective view of a chain link remover for cycles in accordance with the present invention.
Figure 2:
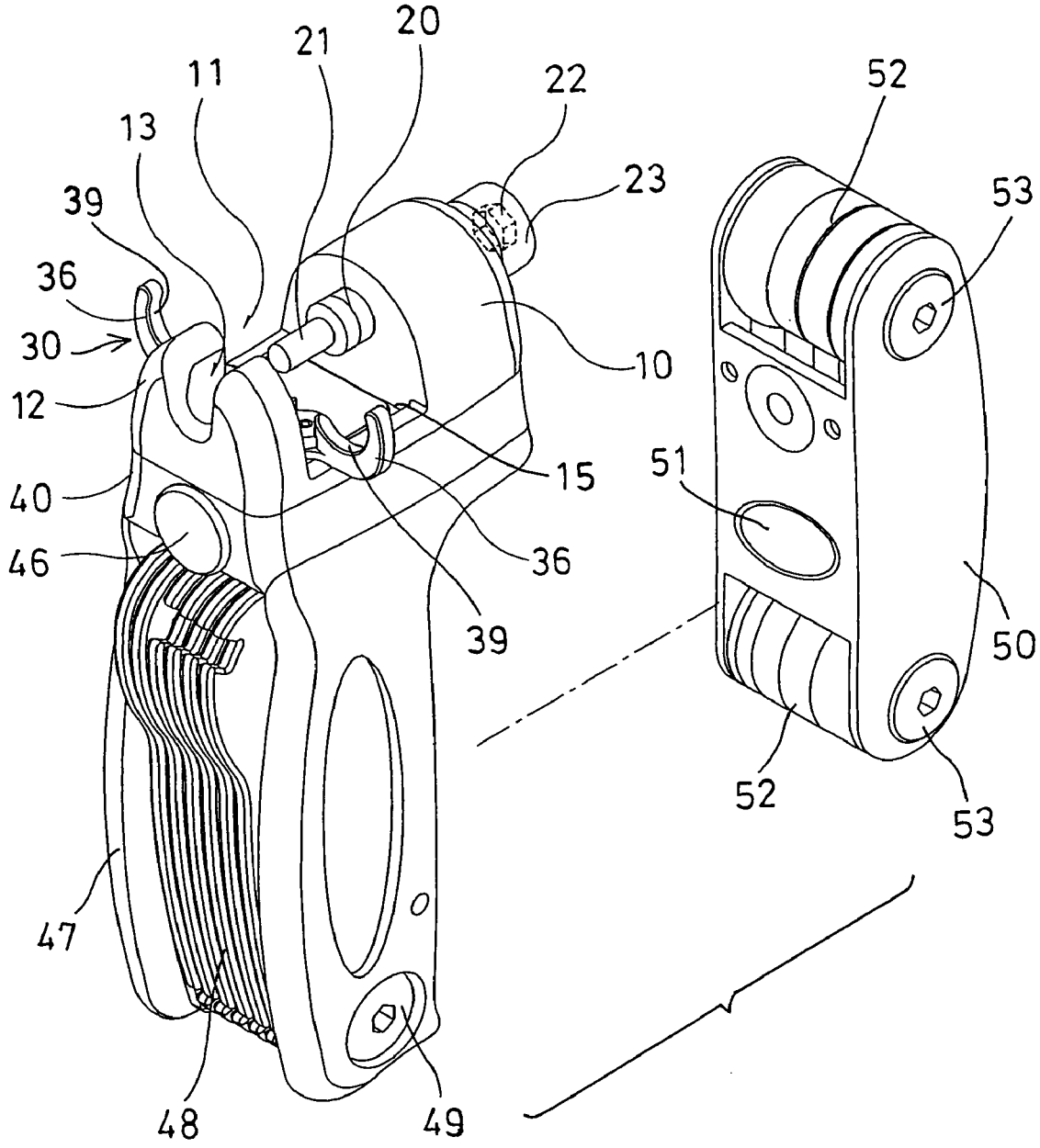
FIG. 2 is a partial exploded view of the chain link remover for cycles.
Figure 3:
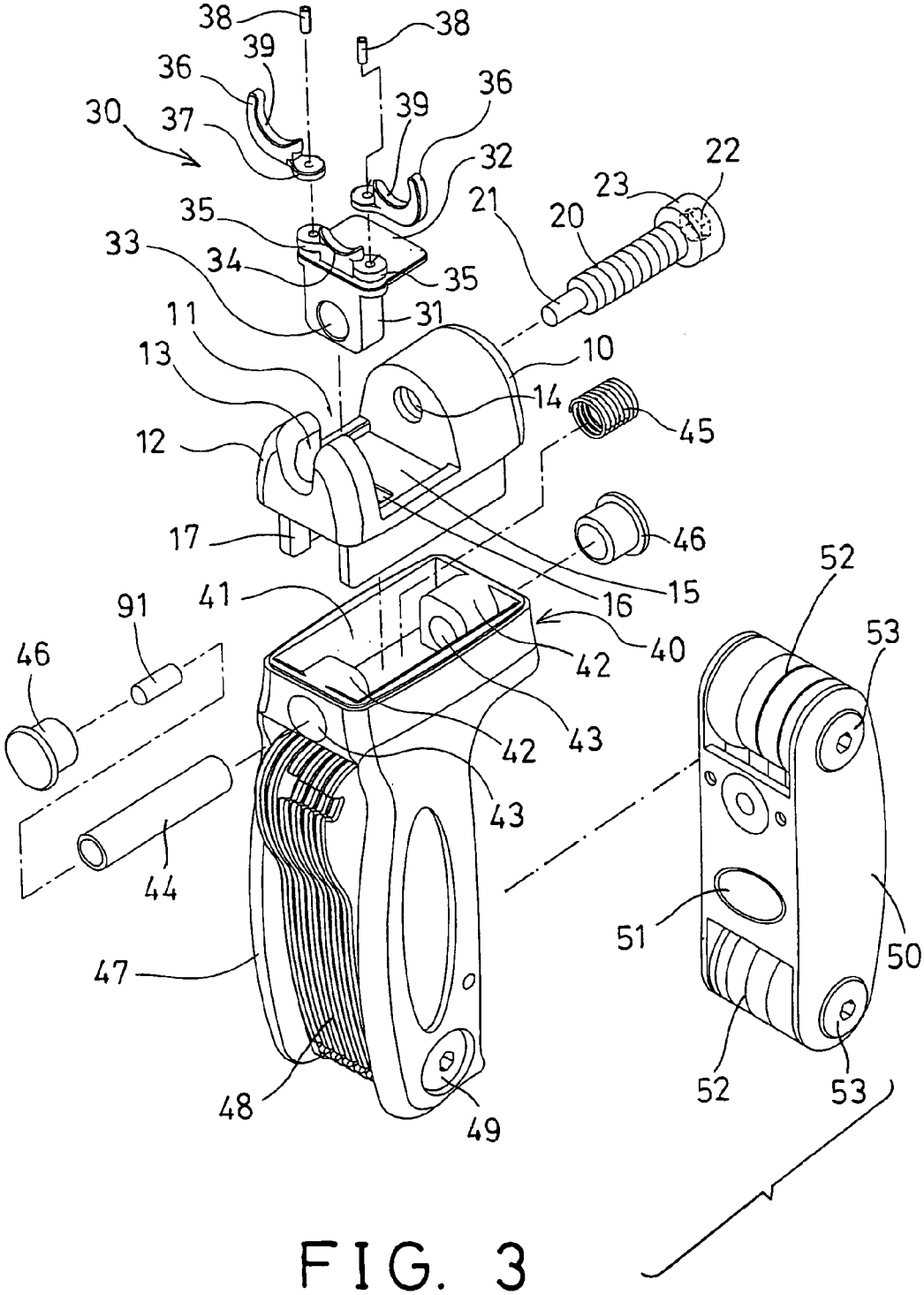
FIG. 3 is another partial exploded view of the chain link remover for cycles.
Figure 4:
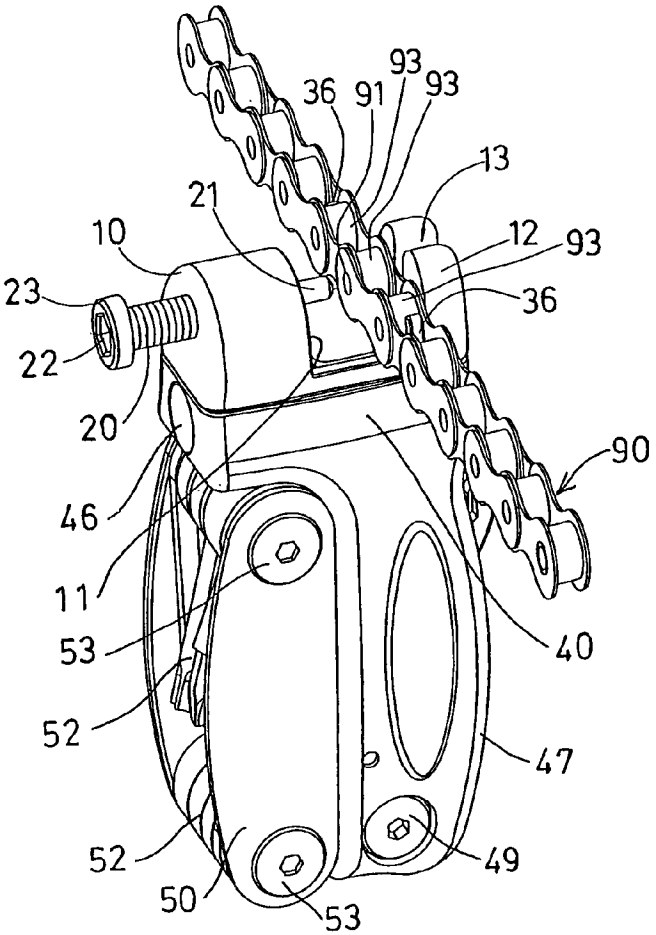
FIGS. 4, 5 are perspective views illustrating the operation of the chain link remover for removing chain link pins from chains.
Figure 5:
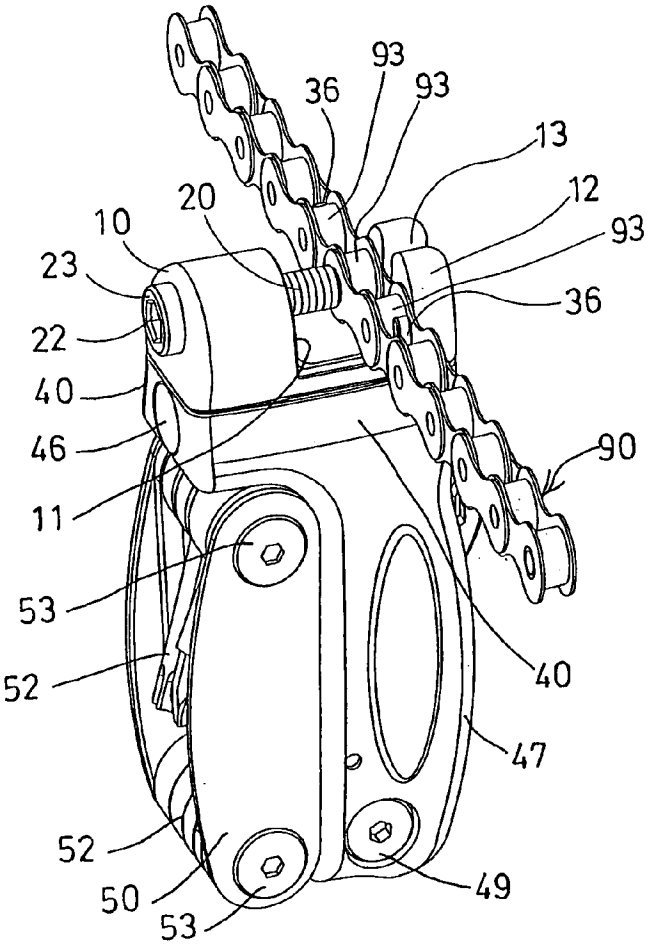

Referring to the drawings, and initially to Figure a chain link remover for cycles in accordance with the present invention comprises a base 10 including an opening 11 formed in the middle portion thereof and defined by an anvil 12 which includes a vertical slot 13 formed therein to receive chain link pins 91 removed from chain links 93 of chains 90 (FIGS. 4–5, 8 and 13).

The base 10 includes a screw hole 14 formed therein and aligned with the vertical slot 13 of the anvil 12, for threading with a threaded shaft 20 which includes a link ejector rod 21 provided on one end thereof for engaging with and for removing the chain link pins 91 from the chain links 93 of the chains 90.

The chain 90 may be engaged into the opening 11 of the base 10, and arranged to have the chain link pins 91 removed from the chain links 93 of the chains 90 with the link ejector rod 21 of the threaded shaft 20. The above described structure of the chain link remover is typical and will not be described in further details.

The chain link remover in accordance with the present invention further comprises a support device 30 disposed in the opening 11 of the base 10, to support and to retain the chain 90 within the opening 11 of the base 10, and to position or to align the chain link pin 91 of the chain links 93 with the screw hole 14 of the base 10 and the link ejector rod 21 of the threaded shaft 20. The base 10 further includes a depression 15 and a passage 16 formed therein and communicating with the opening 11 thereof, and includes one or more extensions 17 extended downwardly therefrom.

As shown in FIGS. 1–9, the support device 30 includes a carrier 31 slidably engaged in the passage 16 of the base 10, and a flap 32 laterally extended from the carrier 31 and slidably engaged in the depression 15 of the base 10, to guide and to limit the carrier 31 to slide and to move relative to the base 10. The carrier 31 includes a bore 33 formed therein, and includes a seat 34 formed or provided thereon to support the chain links 93 (FIGS. 8, 13), and one or more, such as two hubs 35 disposed beside the seat 34.

The support device 30 further includes one or more, such as two curved fingers or pawls 36 each having a hub 37 rotatably or pivotally secured to such as the hubs 35 of the carrier 31 with pivot pins 38, and each having a recess 39 formed therein to receive and support the chain links 93 (FIGS. 8, 13) therein. As best shown in FIGS. 8–9 and 13–14, the pawls 36 preferably include a suitable resilience to clamp such as two chain links 93 between the pawls 36, and thus to stably attach the chain 90 to the base 10, and thus to allow the chain link pin 91 to be easily removed or disengaged from the chain links 93 by the link ejector rod 21 of the threaded shaft 20.

Figure 10:
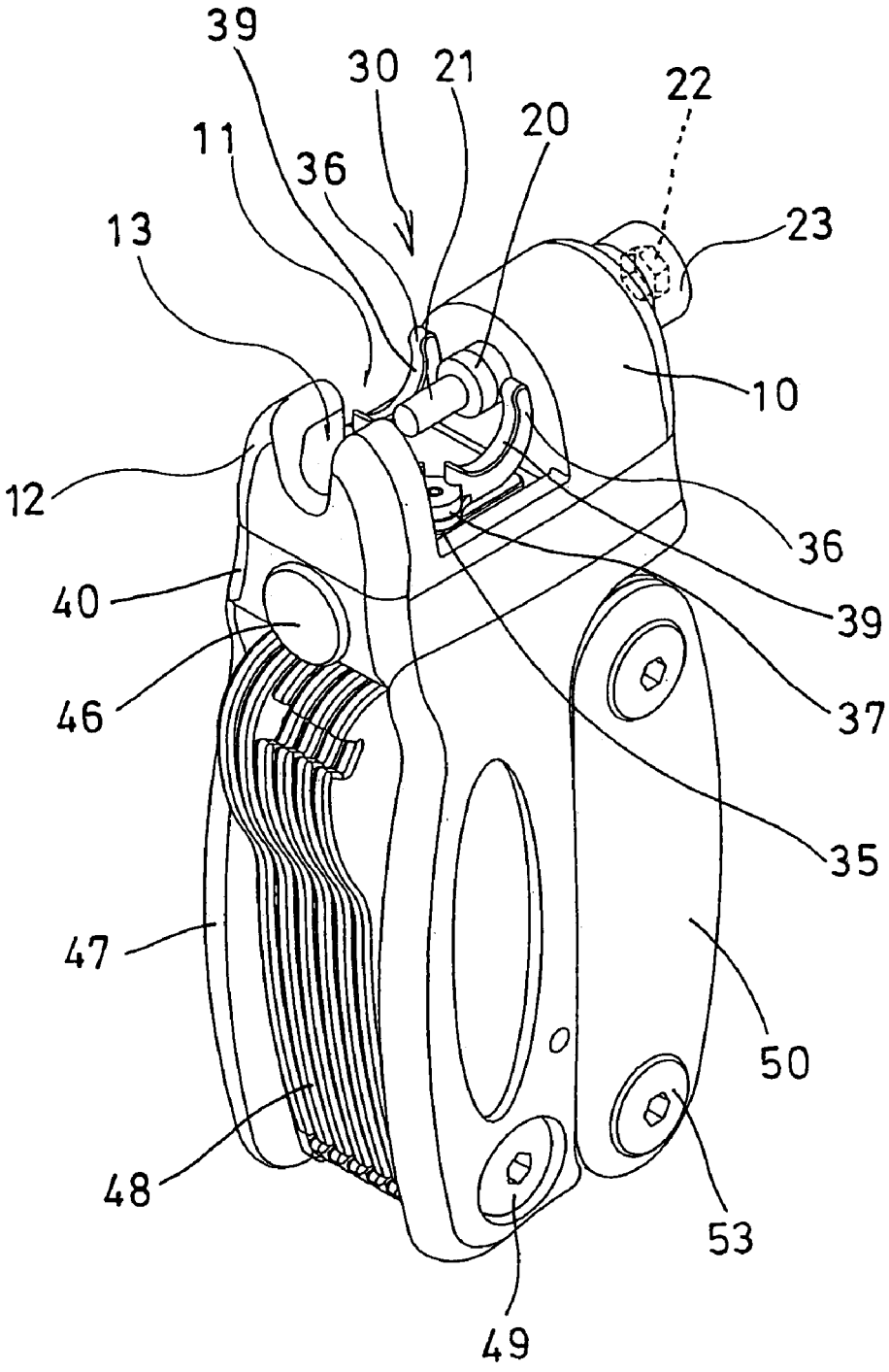
FIG. 10 is a perspective view illustrating the folding operation of the chain link remover.
Figure 11:
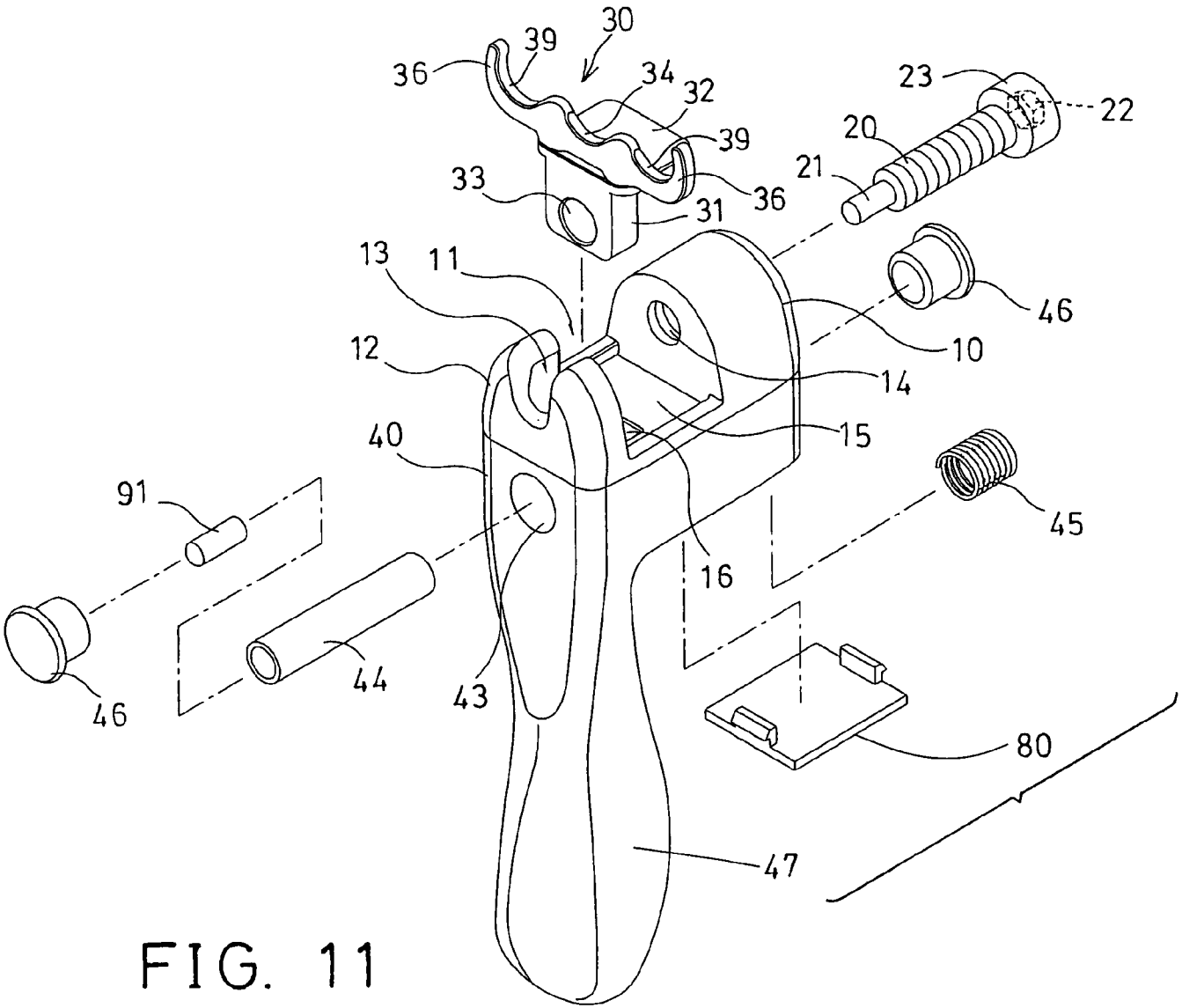
FIG. 11 is a partial exploded view illustrating the other embodiment of the chain link remover for cycles.
Figure 12:
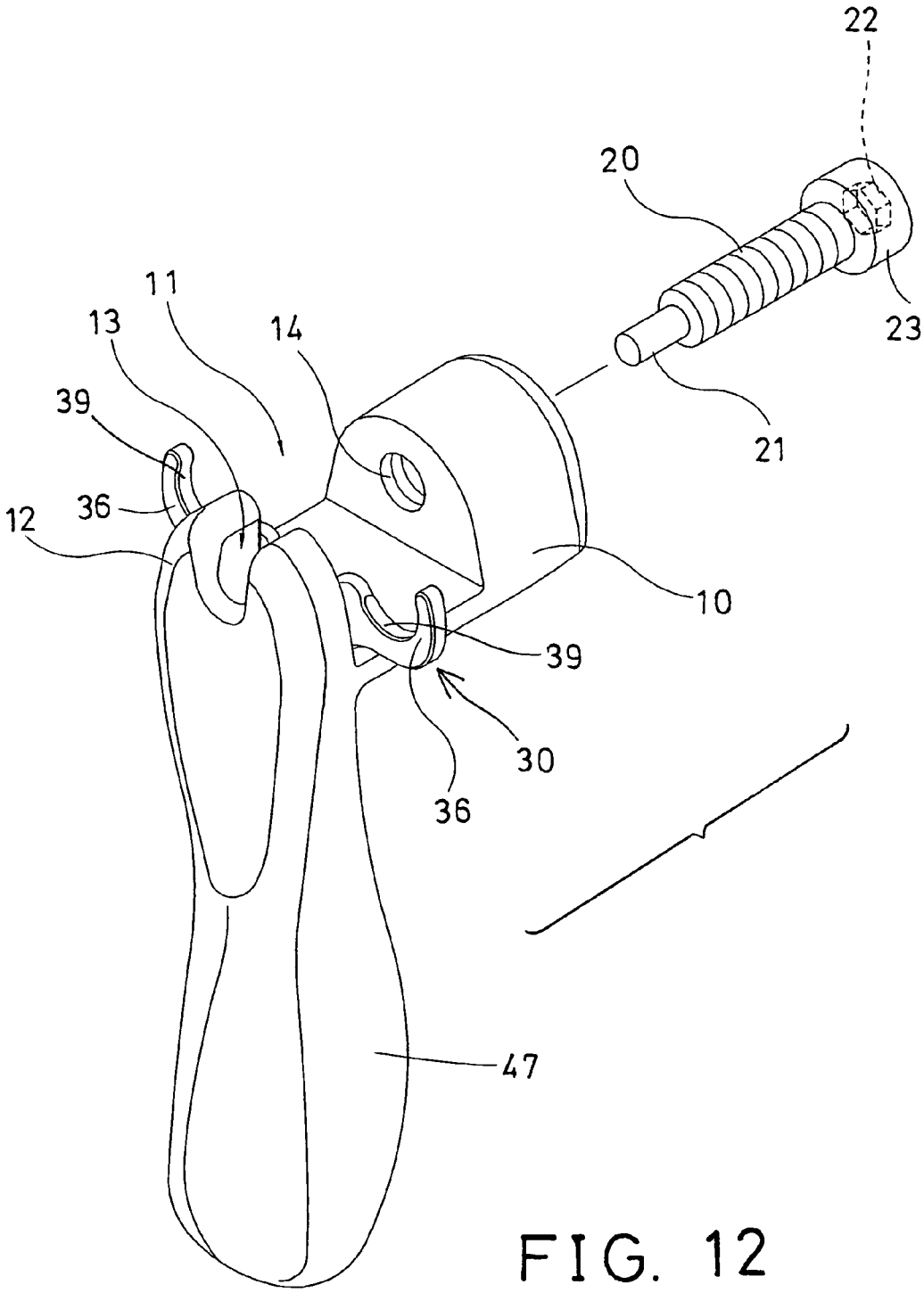
FIG. 12 is another partial exploded view illustrating the further embodiment of the chain link remover for cycles.
Figure 14:
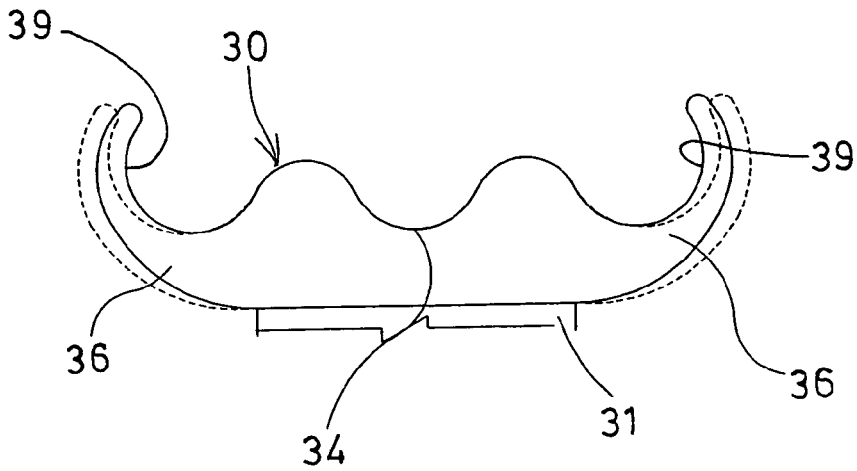
FIGS. 13, 14 are partial plan views illustrating the chain supporting structure of the chain link remover as shown in FIGS. 11 and 12.
Figure 13:
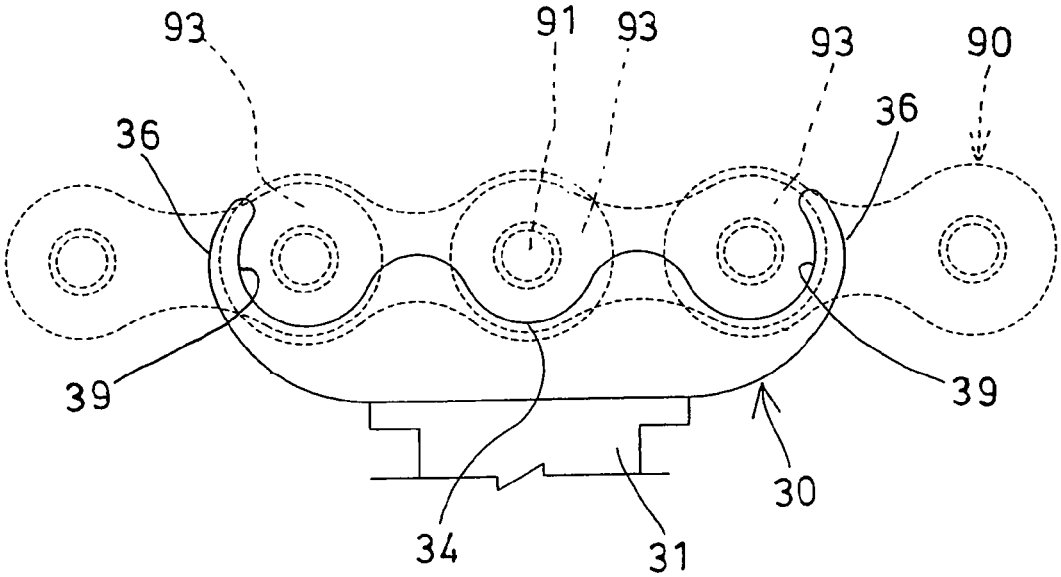
Figure 15:
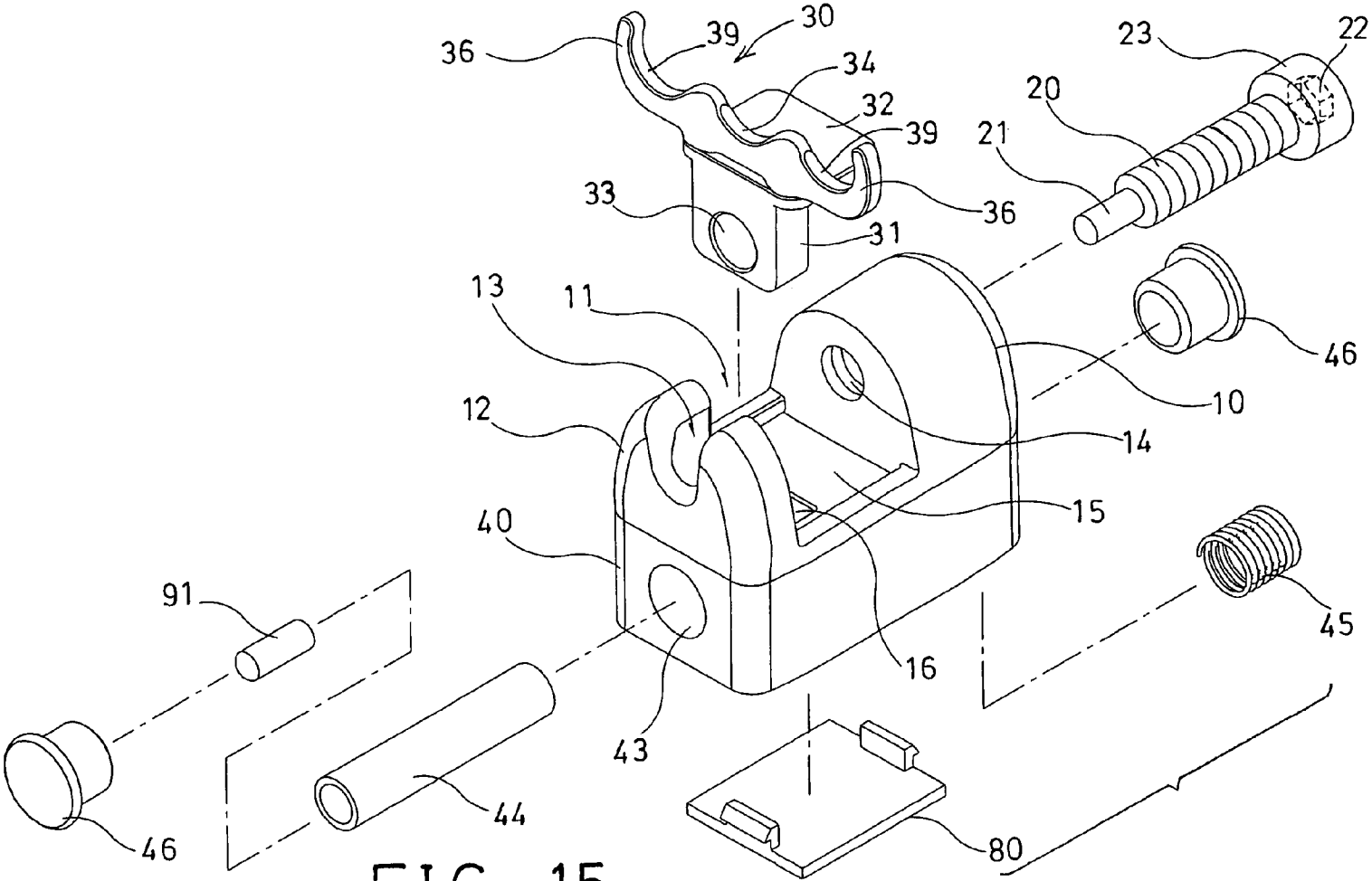
FIG. 15 is a further partial exploded view illustrating the other embodiment of the chain link remover for cycles.
Figure 16:
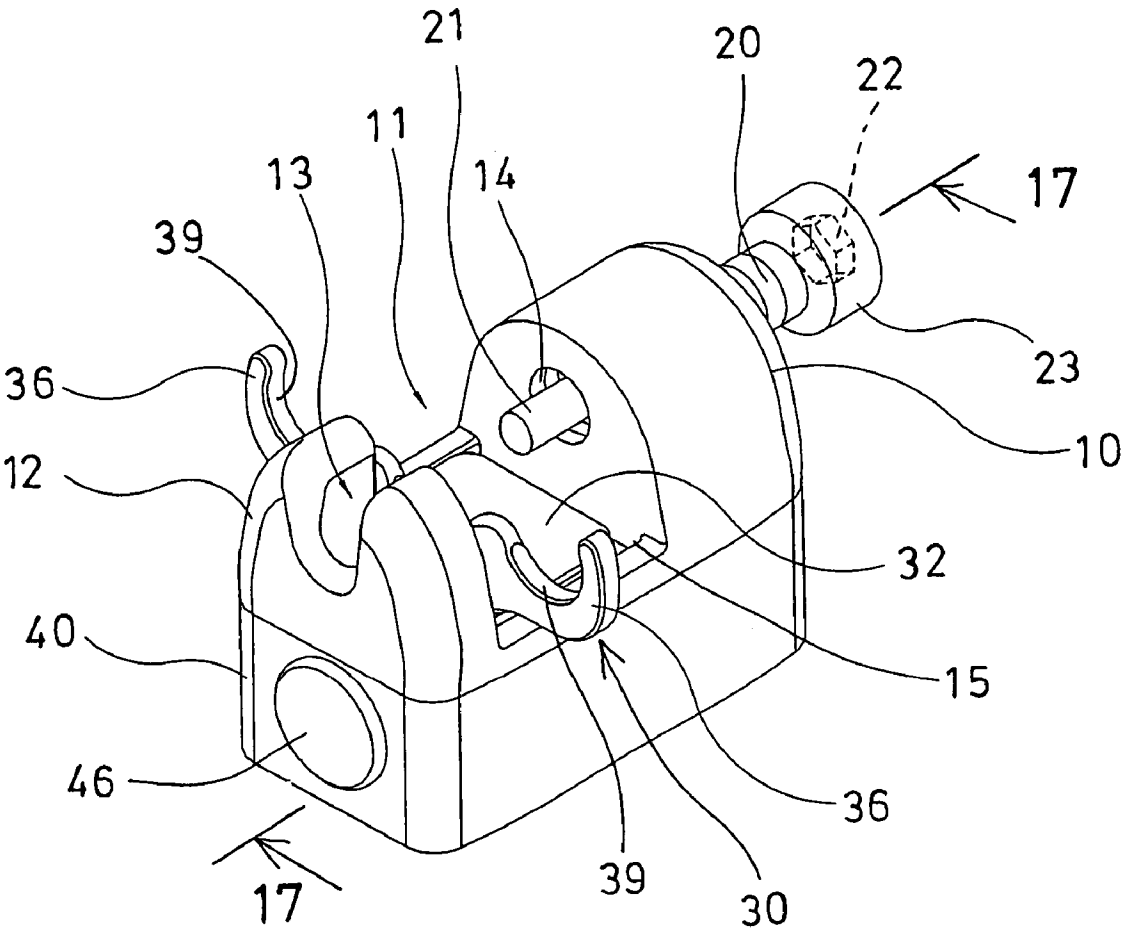
FIG. 16 is a perspective view illustrating the chain link remover as shown in FIG. 15.
Figure 17:
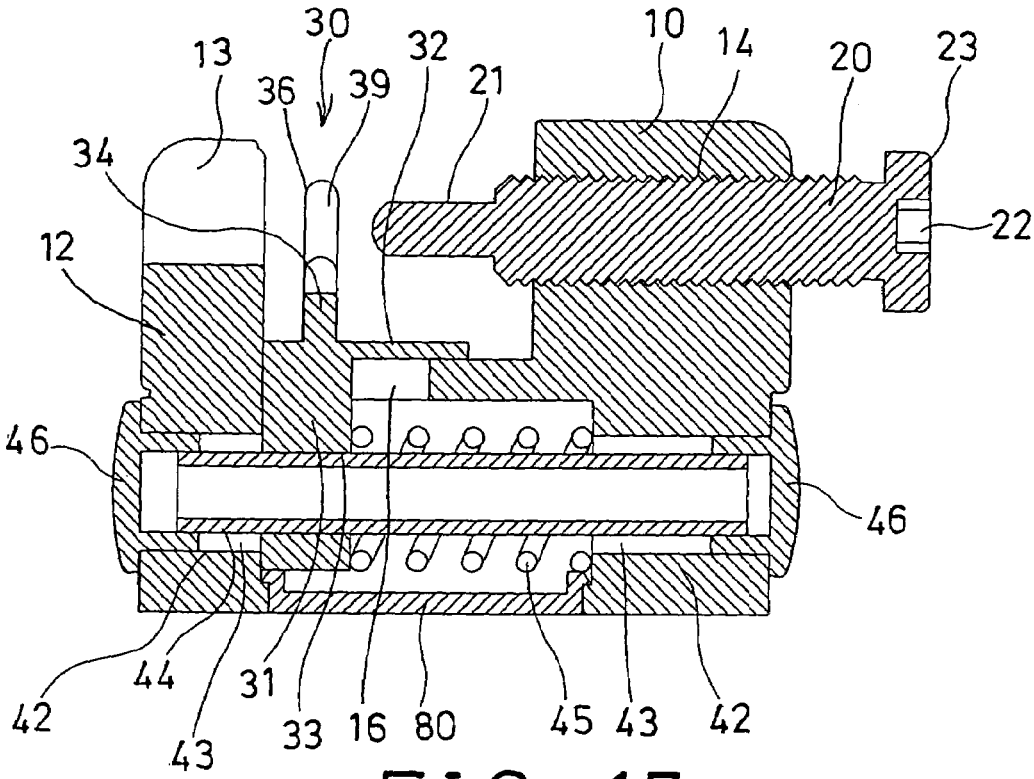
FIG. 17 is a cross sectional view taken along lines 17—17 of FIG. 16.
Figure 18:
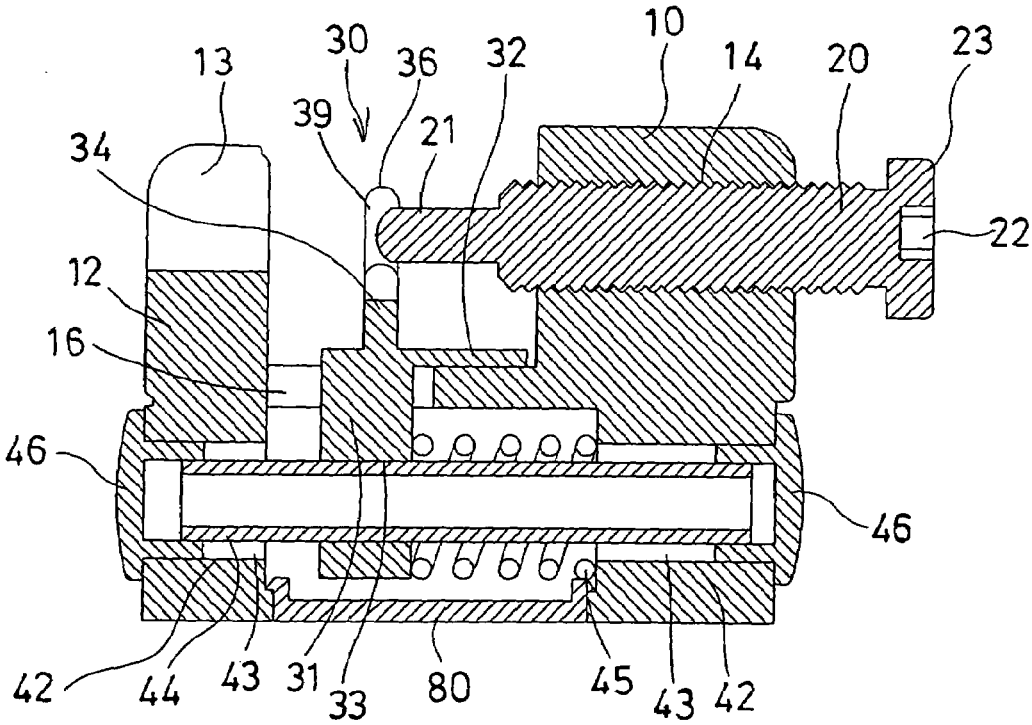
FIG. 18 is a cross sectional view similar to FIG. 17, illustrating the operation of the chain link remover for cycles.
Figure 19:
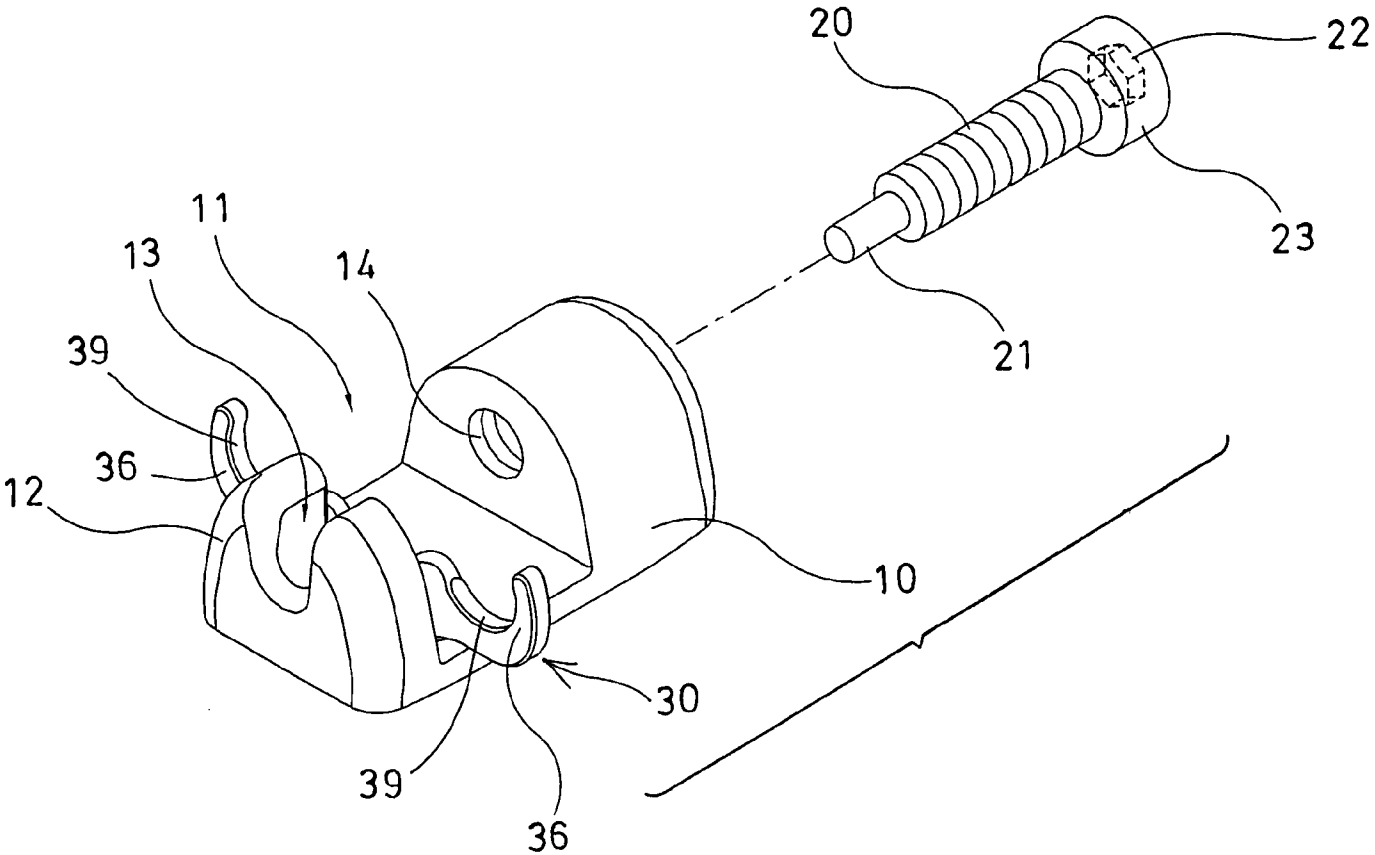
FIG. 19 is a still further partial exploded view illustrating the further embodiment of the chain link remover for cycles.

As shown in FIG. 10, the pawls 36 are foldable or rotatable into the opening 11 of the base 10 in a folding or storing position, or foldable or rotatable out of the opening 11 of the base 10 in a working position (FIGS. 1–2 and 4–5). Alternatively, as shown in FIGS. 11 and 13–18, the pawls 36 may also be formed integral with the carrier 31, and may also be used to resiliently clamp and to retain the chain links 93 between the pawls 36. Further alternatively, as shown in FIGS. 12 and 19, the pawls 36 and the seat 34 may also be formed integral with the base 30, and may also be used to resiliently clamp and to retain the chain links 93 between the pawls 36.

Referring again to FIGS. 1–7, the chain link remover further includes a casing 40 having a chamber 41 formed therein to receive the extensions 17 of the base 10, and two protuberances 42 are extended in the chamber 41 of the casing 40 and each including a hole 43 formed therein to receive a tube 44 therein. The tube 44 is engaged through the bore 33 of the carrier 31, to slidably couple the carrier 31 to the tube 44, and thus to couple or secure the base 10 to the casing 40.

Figure 6:
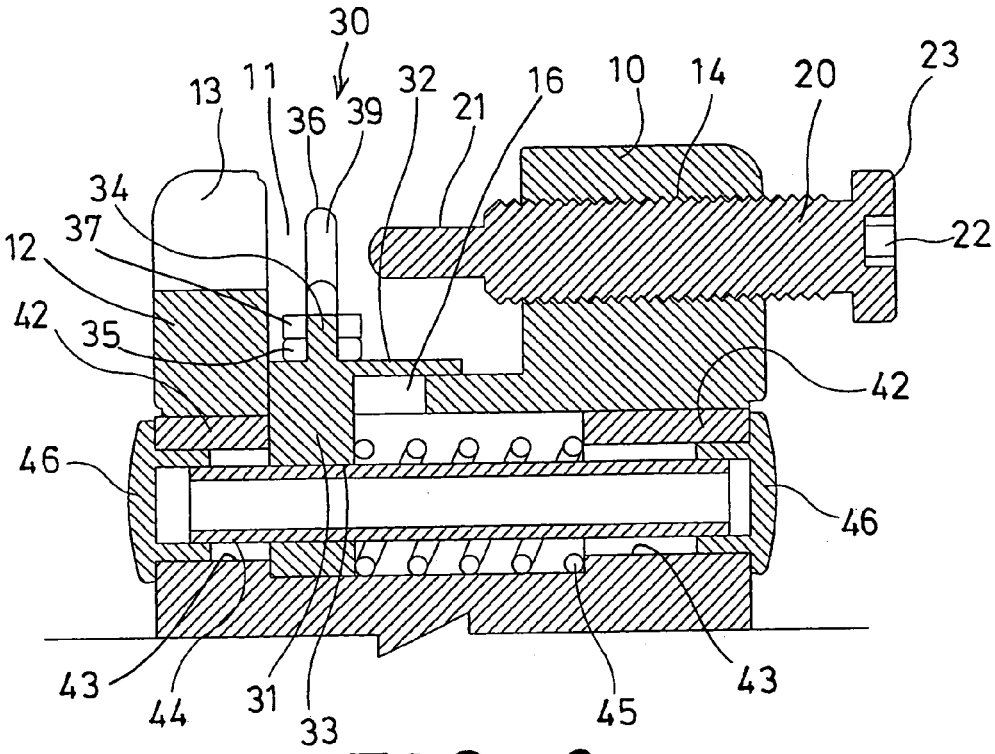
FIG. 6 is a cross sectional view taken along lines 6—6 of FIG. 1.
Figure 7:
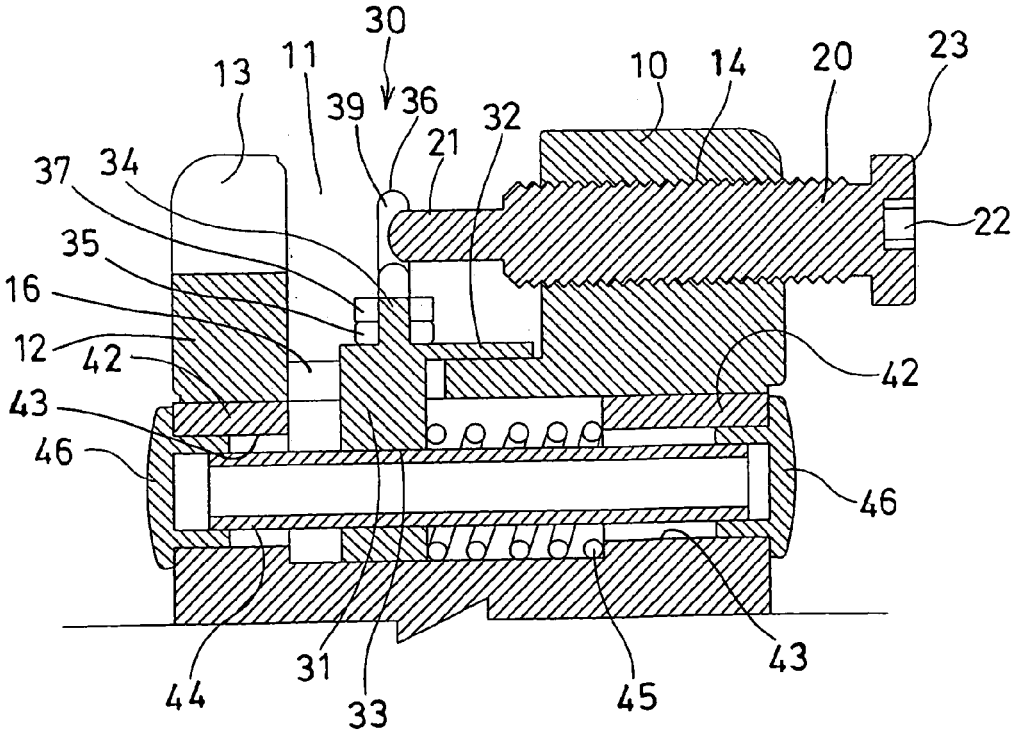
FIG. 7 is a cross sectional view similar to FIG. 6, illustrating the operation of the chain link remover for cycles.
Figure 9:
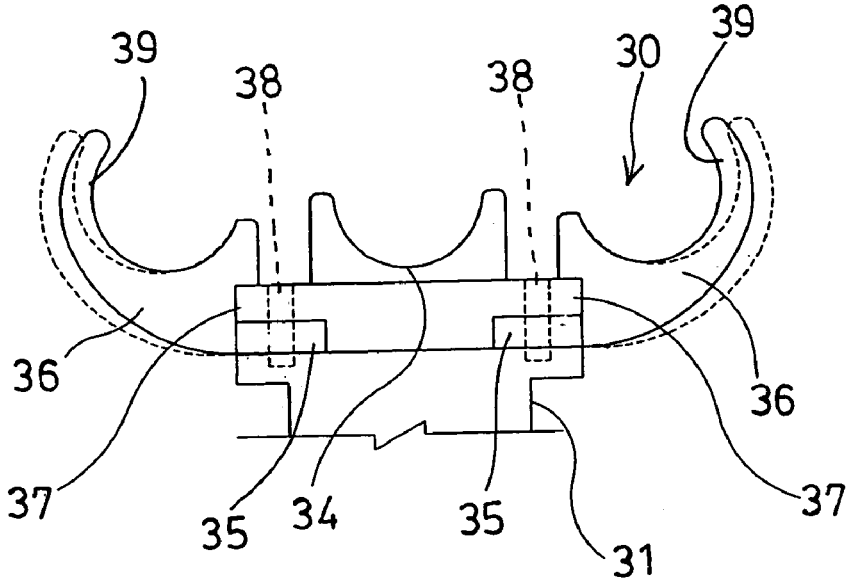
FIGS. 8, 9 are partial plan views illustrating the supporting structure of the chain link remover to support the chain.
Figure 8:
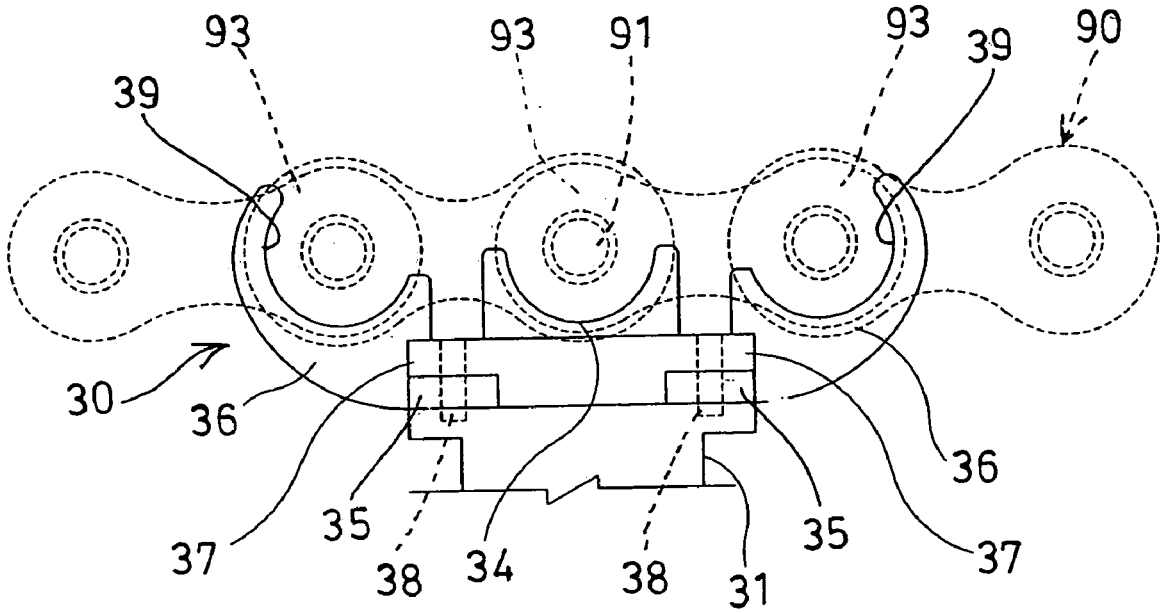

As shown in FIGS. 6–7, the carrier 31 is slidable relative to the base 10 to allow the chain links 93 of different sizes or thicknesses to be engaged onto the seat 34 and the pawls 36 of the support device 30. A spring 45 may be engaged onto the tube 44 and engaged with the carrier 31, to bias the carrier 31 toward or against the anvil 12, and to further stably retain the chain links 93 against the anvil 12, or between the anvil 12 and the link ejector rod 21 of the threaded shaft 20.

One or more further or spare chain link pins 91 may be provided and stored within the tube 44, for replacing or engaging into the chain links 93. Two caps 46 may be attached to the holes 43 of the casing 40, to retain the tube 44 within the casing 40, and to retain the spare chain link pins 91 within the tube 44. The casing 40 may further include a handle 47 extended therefrom (FIGS. 1–5 and 10–12), and one or more tool members 48 may further be provided and rotatably attached to the handle 47 with a pivot axle 49 (FIGS. 1–3 and 10).

As shown in FIGS. 1–5 and 10, a tool device 50 may further be provided and may be attached to the handle 47 of the casing 40 with fasteners (not shown), or may include one or more magnets 51 for attaching to the handle 47 of the casing 40, and may include one or more tool members 52 rotatably attached thereto with one or more pivot pins 53.

Alternatively, as shown in FIGS. 15–18, without the handle 47, the casing 40 may include a cover 80 attached to bottom thereof, to enclose the chamber 41 of the casing 40, and to form a portable structure for the chain link remover. Further alternatively, as shown in FIG. 19, without the handle 47 and the casing 40, the base 10 may also be formed into a portable structure, and may have the support device 30 provided thereon for removing the chain link pins 91 from chain links 93 of chains 90.

In operation, as shown in FIGS. 8–9 and 13–14, the pawls 36 of the support device 30 may be used to clamp and to retain the chain 90 to the support device 30, and to allow the chain link pins 91 to be easily disengaged or removed from the chain links 93 of the chains 90 with the link ejector rod 21 of the threaded shaft 20. The users are not required to use their hands to hold and position the chain 90 to the base 10 or to the support device 30. In addition, the chain link pins 91 may be easily aligned with the link ejector rod 21 of the threaded shaft 20 without further aligning processes. Furthermore, the spring member 45 may bias the carrier 31 of the support device 30 toward or against the anvil 12, and to further stably retain the chain links 93 against the anvil 12, or between the anvil 12 and the link ejector rod 21 of the threaded shaft 20.

Accordingly, the chain link remover for cycles in accordance with the present invention includes a chain support structure to support the chain and to allow the chain link to be easily removed from the chain.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chain link remover comprising:

a base including an opening formed therein and defined by an anvil, said anvil including a vertical slot formed therein to receive a chain link pin of a chain, said base including a screw hole formed therein and aligned with said vertical slot of said anvil, a threaded shaft threaded with said screw hole of said base, and including a link ejector rod for engaging with and for removing the chain link pin from the chain, and a support device provided in said opening of said base to support the chain in said opening of said base, and to retain the chain between said anvil and said threaded shaft, said support device including two pawls to engage with and to support the chain between said anvil and said threaded shaft, and including a carrier to support said pawls thereon, and said pawls being pivotally attached to said carrier with pivot pins respectively.

2. The chain link remover for cycles as claimed in claim 1, wherein said carrier includes two hubs, and each of said pawls includes a hub pivotally attached to said hubs of said carrier with said pivot pins respectively.

3. A chain link remover comprising:

a base including an opening formed therein and defined by an anvil, said anvil including a vertical slot formed therein to receive a chain link pin of a chain, said base including a screw hole formed therein and aligned with said vertical slot of said anvil, a threaded shaft threaded with said screw hole of said base, and including a link ejector rod for engaging with and for removing the chain link pin from the chain, and a support device provided in said opening of said base to support the chain in said opening of said base, and to retain the chain between said anvil and said threaded shaft, said support device including two pawls to engage with and to support the chain between said anvil and said threaded shaft, and including a carrier to support said pawls thereon, and said base including a passage formed therein to slidably receive said carrier.

4. A chain link remover comprising:

a base including an opening formed therein and defined by an anvil, said anvil including a vertical slot formed therein to receive a chain link pin of a chain, said base including a screw hole formed therein and aligned with said vertical slot of said anvil, a threaded shaft threaded with said screw hole of said base, and including a link ejector rod for engaging with and for removing the chain link pin from the chain, and a support device provided in said opening of said base to support the chain in said opening of said base, and to retain the chain between said anvil and said threaded shaft, said support device including two pawls to engage with and to support the chain between said anvil and said threaded shaft, and including a carrier to support said pawls thereon, and said base including a depression formed therein, and said carrier including a flap laterally extended therefrom and slidably engaged in said depression of said base.

5. A chain link remover comprising:

a base including an opening formed therein and defined by an anvil, said anvil including a vertical slot formed therein to receive a chain link pin of a chain, said base including a screw hole formed therein and aligned with said vertical slot of said anvil, a threaded shaft threaded with said screw hole of said base, and including a link ejector rod for engaging with and for removing the chain link pin from the chain, a support device provided in said opening of said base to support the chain in said opening of said base, and to retain the chain between said anvil and said threaded shaft, said support device including two pawls to engage with and to support the chain between said anvil and said threaded shaft, and including a carrier to support said pawls thereon, and a spring engaged with said carrier, to bias said carrier against said anvil.

6. The chain link remover for cycles as claimed in claim 5 further comprising a tube, said carrier including a bore formed therein to slidably receive said tube, and to slidably attach said carrier onto said tube, said spring being engaged on said tube.

7. The chain link remover for cycles as claimed in claim 6 further comprising a casing to receive said tube.

8. The chain link remover for cycles as claimed in claim 7, wherein said casing includes two protuberances each having a hole formed therein to receive said tube therein.

9. The chain link remover for cycles as claimed in claim 8, wherein said casing includes two caps attached to said holes, to retain said tube in said casing.

10. The chain link remover for cycles as claimed in claim 7, wherein said casing includes a handle extended therefrom.

11. The chain link remover for cycles as claimed in claim 10, wherein said casing includes at least one tool member attached to said handle.

12. The chain link remover for cycles as claimed in claim 10 further comprising a tool device detachably attached to said handle.

13. The chain link remover for cycles as claimed in claim 12, wherein said tool device includes at least one magnet for magnetically attaching said tool device to said handle.

14. The chain link remover for cycles as claimed in claim 7, wherein said casing includes a cover attached to bottom thereof.

15. The chain link remover for cycles as claimed in claim 6 further comprising at least one spare chain link pin received in said tube.

16. The chain link remover for cycles as claimed in claim 1, wherein said carrier includes a seat provided thereon and disposed between said pawls.

* * * * *